US006845631B1

(12) United States Patent
Hallin et al.

(10) Patent No.: US 6,845,631 B1
(45) Date of Patent: Jan. 25, 2005

(54) ABSORPTION REFRIGERATOR

(75) Inventors: Anders Bengt Ingemar Hallin, Lidingö (SE); Johnny Kornelind, Tyresö (SE)

(73) Assignee: Dometic Sweden AB, Solna (SE)

( * ) Notice: Subject to any disclaimer, the term of this patent is extended or adjusted under 35 U.S.C. 154(b) by 0 days.

(21) Appl. No.: 10/619,675

(22) Filed: Jul. 15, 2003

(51) Int. Cl.[7] ..... F25B 15/00
(52) U.S. Cl. ..... 62/476; 62/457.9; 62/478
(58) Field of Search ..... 62/147, 457.9, 62/467, 476, 478, 492

(56) References Cited

U.S. PATENT DOCUMENTS

| | | | | |
|---|---|---|---|---|
| 1,781,758 A | | 11/1930 | Larsen | |
| 2,815,649 A | | 12/1957 | Angelus et al. | |
| 2,943,455 A | | 7/1960 | Reverman, Jr. | |
| 3,382,683 A | | 5/1968 | Wiljanen | |
| 4,691,529 A | * | 9/1987 | Blomberg et al. | 62/332 |
| 5,375,432 A | | 12/1994 | Cur | |
| 5,966,951 A | * | 10/1999 | Hallin et al. | 62/141 |

FOREIGN PATENT DOCUMENTS

| | | |
|---|---|---|
| DE | 1 035 174 | 7/1958 |
| GB | 566749 | 1/1945 |

* cited by examiner

*Primary Examiner*—Melvin Jones
(74) *Attorney, Agent, or Firm*—Pearne & Gordon LLP

(57) ABSTRACT

An absorption refrigerator (1) including a cabinet having outer walls (2, 3, 4, 5, 6) and at least one door (7, 8) encasing a low temperature storage compartment (9) and a higher temperature storage compartment (10), said compartments being essentially sealed from each other and separated by a partition wall (11), which partition wall is arranged inside the cabinet and generally perpendicular to a first wall (2) of said outer walls. The refrigerator further comprises an absorption refrigerating system including an evaporator tube (20), having a first section (21) for absorbing heat from the low temperature compartment and a second section (22) for absorbing heat from the higher temperature compartment, said second section being arranged downstream said first section. In order to reduce heat transfer into the cabinet through the outer walls, a major part of the first section is arranged generally in parallel with said partition wall.

9 Claims, 2 Drawing Sheets

ABSORPTION REFRIGERATOR

FIELD OF THE INVENTION

The present invention relates to an absorption refrigerator including a cabinet having outer walls and at least one door encasing a low temperature storage compartment and a higher temperature storage compartment, said compartments being essentially sealed from each other and separated by a partition wall, which partition wall is arranged inside the cabinet and generally perpendicular to a first wall of said outer walls, and an absorption refrigerating system including an evaporator tube having a first evaporator tube section for cooling the low temperature compartment and a second evaporator tube section for cooling the higher temperature compartment, said second evaporator tube section being arranged downstream said first evaporator tube section.

BACKGROUND OF THE INVENTION

Absorption refrigerators have been commonly used in e.g. recreation vehicles and mobile homes for a long time. More recently, so called side-by-side absorption refrigerators have been increasingly popular also in such mobile applications. In side-by-side refrigerators a freezing compartment and a food storage compartment, which is kept at a higher temperature, are arranged vertically side by side and separated by a vertical partition wall. The evaporator tube is normally arranged in or at the rear wall of the refrigerator cabinet. The evaporator has a first freezer section, which extends in or at an interior surface of a portion of the rear wall, which portion covers the freezer. A second downstream section of the evaporator is arranged to cool the higher temperature compartment and extends in or at an interior surface of a portion of the rear wall, which portion covers the higher temperature compartment.

A problem with this type of absorption refrigerator cabinets is a considerable heat transfer through the rear wall from the outside of the cabinet to the inside. Such inwardly directed heat transfer is driven by the difference in temperatures between the outside and the inside of the cabinet. Therefore, the heat transfer through the surrounding walls is particularly high into the freezer compartment. The freezer section of the evaporator is the coldest section of the evaporator. Since the freezer section is arranged in or at the rear wall of the freezer compartment, this freezer rear wall will have the lowest temperature of all the walls surrounding the refrigerator cabinet. Thus, the difference in temperature between the surrounding atmosphere and the inside of the cabinet walls is greatest at the rear freezer wall. Therefore, heat transfer into the cabinet is also greatest through the rear wall of the freezer compartment, near to the freezer section of the evaporator.

Heat transfer into the refrigerator cabinet is particularly disadvantageous at absorption refrigerators used in mobile applications. At absorption refrigerators, the physical dimensions of the refrigeration system limit the maximum cooling capacity. This makes it difficult to keep the respective compartments at the desired temperature. This problem is particularly severe for the freezer compartment, for which, at modern mobile refrigerators, it is desired to keep the temperature as low as −18° C. Any heat which is added into the cabinet is therefore most undesirable and often causes the temperature in the freezer to raise above the desired value. This in turn deteriorates the quality of foodstuff stored in the freezer or reduces the maximum possible storage time.

A further problem with the above-described known refrigerator is that the time required for lowering the freezer temperature from the starting temperature to the desired freezer temperature at start up of the system (so called "pull-down") is relatively long. This is partly caused by the fact that the freezer section of the evaporator is arranged in or at one of the outer walls of the cabinet. The insulation inside the outer walls has to be comparatively thick and it contains a considerable amount of heat, which is absorbed by the evaporator during the initial temperature reduction in the freezer compartment. Considerable cooling capacity of the refrigeration system is thus used for absorbing heat from the outer wall instead of the air inside the freezer compartment, whereby the pull-down time is extended.

BRIEF DESCRIPTIONS OF THE INVENTION

It is an objective of the present invention to provide an absorption refrigerator at which the cooling capacity of the refrigerating system is more efficiently used for keeping the items stored in the cabinet at the desired temperature.

It is a further object to provide an absorption refrigerator at which the heat transfer through the surrounding walls into the cabinet is reduced.

A further object is to provide an absorption refrigerator at which the heat transfer particularly into the freezer compartment is reduced.

A still further object is to provide an absorption refrigerator at which the time needed for lowering the freezer temperature to the desired temperature at start up is reduced. These and other objects are achieved by a refrigerator according to the first paragraph of this description at which a major part of said first evaporator tube section is arranged generally in parallel with said partition wall.

By such an arrangement of that section of the evaporator, which absorbs heat from the freezer compartment, it is assured that at least the major part of this section is arranged at a distance from the rear walls. Thereby, the major part of the freezer evaporator predominantly absorbs heat from the air in the freezer compartment and no superfluous cooling of the outer walls is caused. The outer walls thus remain at a higher temperature, whereby heat transfer from the surrounding atmosphere through the outer walls is reduced. The reduction of heat absorbed from the outer walls also reduces the time for lowering the freezer temperature at start-up. Also when the freezer section of the evaporator is arranged in or in the proximity of the dividing wall, the pull-down time is reduced since the heat contained in the dividing wall at start-up is considerably less than that in the outer walls, due to thinner insulation. Further more, such placement of the freezer section contributes to lowering the temperature in the higher temperature compartment, on the other side of the dividing wall.

Further objects and advantages of the invention are set out in the depending claims. According to one embodiment, the partition wall is arranged as a vertical wall extending between the outer rear wall and the front door or doors. Thereby, the invention is advantageously applied to a modern side-by-side refrigerator. The second section of the evaporator, which cools the higher temperature compartment, may be arranged in parallel with the rear wall. This may be advantageous for space saving or tube bending purposes and such placement of the second section of the evaporator does not to the same extent contribute to the heat transfer into the higher temperature compartment, since this evaporator section is kept at a higher temperature. The freezer section of the evaporator may be arranged in parallel to, and in proximity to the partition wall. Hereby, a gap may be arranged between the evaporator freezer section and the partition wall. Such a gap allows for air to freely circulate around the freezer evaporator section, which enhances heat transfer from the air in the freezer compartment to the evaporator. Further more, such a gap prevents that the freezer evaporator absorbs heat from the partition wall, whereby the system is more efficiently used for cooling the air and items stored in the freezer compartment. This also contributes to reduce the pull-down time even further. The freezer section of the evaporator may also be arranged entirely or partly in the dividing wall, whereby the space requirement for the evaporator inside the freezer cabinet is reduced. In order to further enhance the heat transfer from the air to the evaporator, at least a portion of the evaporator may be provided with heat transferring flanges.

DETAILED DESCRIPTION OF THE INVENTION

An exemplifying embodiment of the invention will now be described with reference to the accompanying drawings in which.

Figure 1:
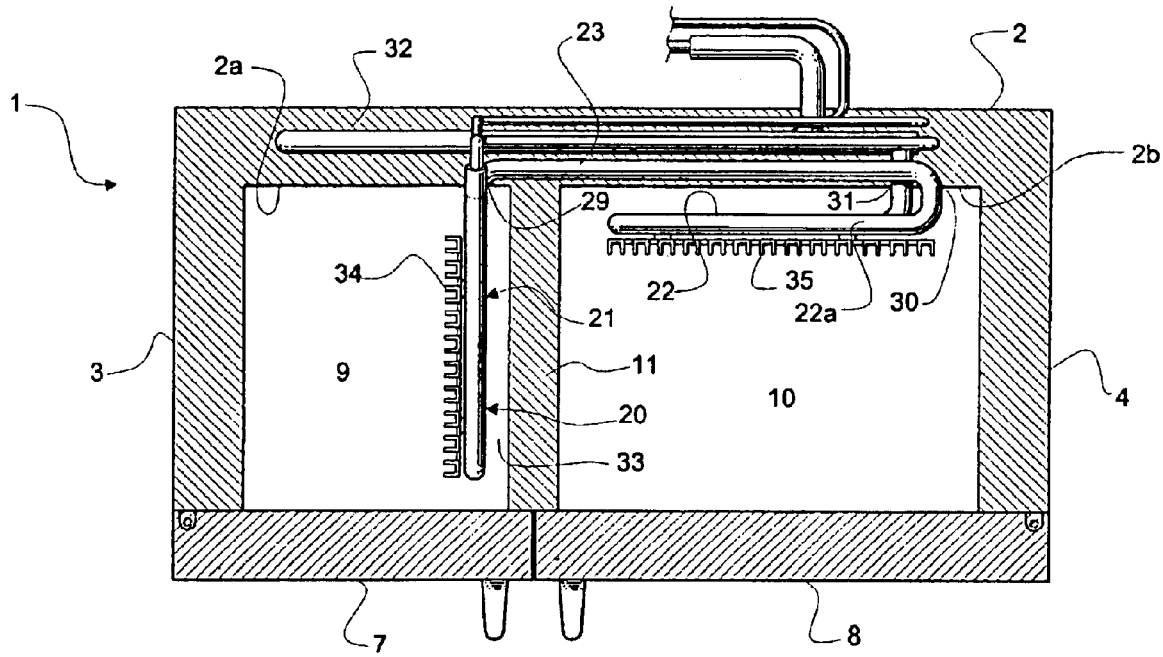
FIG. 1 is a top elevation view, with parts of the walls broken away, of a refrigerator cabinet according to the present invention.
Figure 2:
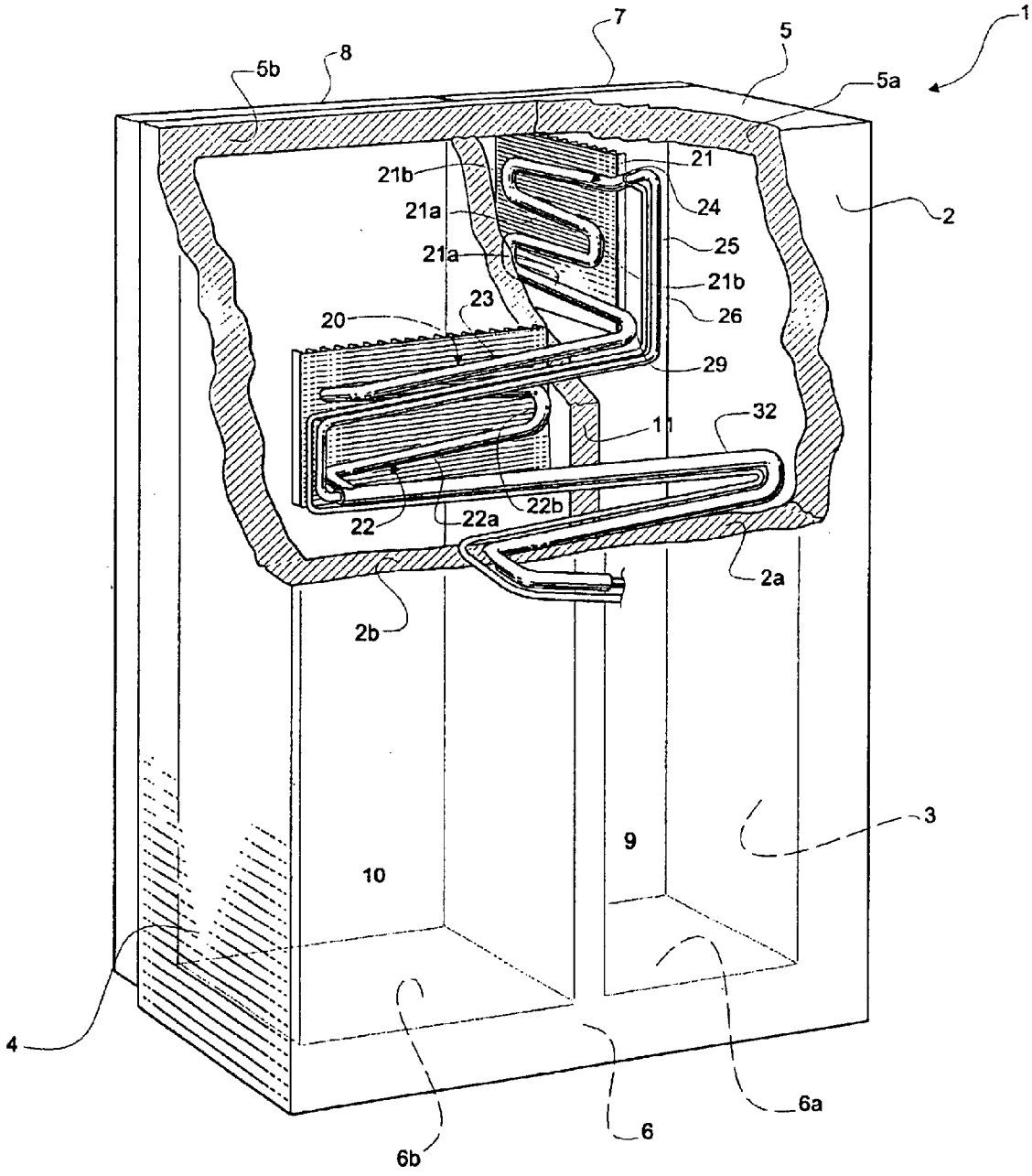
FIG. 2 is a perspective view from behind, with parts broken away, of the refrigerator in FIG. 1.

In the figures a side-by-side absorption refrigerator 1 is shown. The cabinet includes a rear wall 2, two side walls 3, 4, a top-wall 5 and a bottom-wall 6. These outer walls 2-6, together with two front doors 7, 8 enclose a low temperature storage compartment 9 and a higher temperature storage compartment 10. The outer walls 2–6 and the front doors 7, 8 all include an outer and an inner shell between which heat insulating material, such as polyurethane foam, is arranged. The two compartments 9, 10 are hermetically sealed from each a vertical partition wall 11, which extends perpendicular to and from the rear wall 2, between the rear wall 2 and the front of the cabinet 1, in such away that the doors 7 and 8, when closed, sealingly rest against the front of the partition wall 11. The freezer compartment 9 is thus defined by the (in FIG. 1) left front door 7, the partition wall 11, the side wall 3, and respective portions 2*a*, 5*a*, 6*a* of the rear wall, top wall and bottom wall. The higher temperature compartment 10 is analogously defined by the (in FIG. 1) right front door 8, the partition wall 11, the side wall 4, and respective portions 2*b*, 5*b*, 6*b* of the rear wall, top wall and bottom wall. The partition wall is placed approximately ⅓ of the total width of the cabinet from one side-wall 3, so that the width-relationship between the freezer compartment 9 and the refrigerator compartment is approximately 1:2.

During operation, the temperature in the freezer compartment is normally kept at about −18° C., whereas the higher temperature compartment normally is kept at about +5° C. The higher temperature compartment 10 could also be referred to as a refrigerator compartment.

For cooling the two compartments 9, 11, an absorption refrigerator system including a conventional boiler, condenser, and absorber (neither of which is shown) is arranged at the back of the cabinet, outside the rear wall 2. The refrigerator system also includes an evaporator, generally indicated by reference number 20. The evaporator 20 is formed of an evaporator tube, which includes a first evaporator tube section 21 for cooling the freezer compartment and a second evaporator tube section 22 for cooling the higher temperature compartment 10. The first section 21 is arranged inside the freezer compartment 9 and the second section 22 inside the higher temperature compartment 10. The two evaporator sections 21 and 22 are connected through a passive section 23, which is embedded in the insulation of the rear wall 2. This passive section 23 does not absorb heat from any of the two compartments. However, it functions as a heat exchanger absorbing heat from the mediums in the conduits 25 and 26.

At the upper, upstream end 24 of the evaporator 20, a first conduit 25 supplies the coolant, such as liquid ammonium, from the condenser to the evaporator 20. At the same upstream end 24, a second conduit 26 supplies poor gas from the absorber.

The first evaporator tube section 21 is arranged immediately downstream of the upstream end 24 of the evaporator. The first evaporator section 21 is formed by four generally straight tube sections 21*a*, which are connected, one after the other through three tube bends 21*b*. The straight tube sections 21*a* and the tube bends 21*b* are arranged vertically, one over the other, generally in the same vertical plane. At a lead-through 29, which is arranged through the inner shell of the freezer rear wall portion 2*a*, at the downstream end of the first evaporator section, the first evaporator section 21 is connected to the passive evaporator section 23. The passive section 23 extends inside the rear wall 2 at a slight downward slope, past the partition wall 11 and is connected to the upstream end of the second evaporator section 22 at a lead-through 30 in the refrigerator portion 2*b* of the rear wall 2. The second evaporator section 22 includes two generally straight tube portions 22*a*, which are arranged, one over the other, generally in the same vertical plane and connected by a tube bend 22*b*. At the down-stream end of the second evaporator section 22, a lead-through 31 leads the evaporator tube into the rear wall 2, where the evaporator tube, together with the coolant supply conduit 25 is connected to a co-axial gas heat exchanger tube 32. The co-axial tube 32 extends in the rear wall 2, in a generally U-shaped manner and exits through the outer shell of the rear wall. At the back of the refrigerator cabinet, the co-axial tube 32 is connected to the absorber of the refrigerating apparatus (not shown).

During normal operation, the temperature of the refrigerating medium in the evaporator is typically maintained at approx. −30° C. at the upstream end 24 of the first evaporator section. At the downstream end 29 of the first evaporator section 21, the coolant temperature has typically risen to approx. −24° C. During the passage of the coolant through the passive evaporator section 23, the temperature increases due to absorption of heat from the adjacent conduits 25, 26, whereby the temperature at the upstream end of the second evaporator section is about −18° C. During passage through the second evaporator section 22 the coolant temperature is typically raised to approx. −14° C.

As can be seen from the figures, the first evaporator section 21 is arranged such that the evaporator tube 21*a*, 21*b* of this section 21 forms a vertical general extension plane of the section, which plane is defined by the logidudinal axis of the four evaporator tube portions 21*a*. The first evaporator section 21 is further arranged inside the freezer compartment 9, in the upper half of this compartment 9. The first evaporator section 21 is also arranged such that its general extension plane lies in parallel with the vertical extension plane of the partition wall 11. Further, the first evaporator section 21 is arranged at a small distance from the surface of the partition wall, which surface faces the freezer compartment 9, such that a gap 33 is formed between the partition wall 9 and the first evaporator section 21. For enhancing the heat transfer from the air in the freezer compartment 9 to the first evaporator section 21, a flanged baffle element 34 of a heat conducting material is attached to the first evaporator section. The baffle element 34 exhibits a generally comb-shaped transverse section and includes a base and a plurality of flanges having a vertical longitudinal direction. In the shown embodiment, one baffle element 34 is arranged on the side of the first evaporator section 21, which side faces away from the gap 33 and the partition wall 11. However, it is also contemplated that one or several flanged baffle elements other heat transferring means could be attached to either or both sides of the first evaporator section 21.

By the arrangement of the first evaporator section 21 described above it is accomplished that, during operation of the refrigerating system, the freezer evaporator section 21 predominantly absorbs heat from the air in the freezer compartment 9 and not directly from any of the surrounding walls 2–6, the doors 7, 8 or the partition wall 11. Hereby, the outer walls 2–6 and the doors 7, 8 are not superfluously cooled. The heat transfer into the freezer compartment through the outer walls and doors, which is driven by the temperature difference between the inner and outer surfaces of the outer walls and doors, is therefore maintained at a minimum.

The gap 33 allows for air to circulate around the first evaporator section 21, which enhances the heat transfer from the coolant fluid inside the first evaporator section.

In the higher temperature refrigerator compartment 10, the second evaporator section 22 is arranged in an analogue manner. In the shown embodiment however, the longitudinal directions of the two second evaporator tube portions 22*a* define a vertical general plane of extension, which is arranged in parallel with the rear wall 2. Since the second evaporator section is maintained at a considerably higher temperature than the first evaporator section 9, such an arrangement does not adversely contribute to any significant heat transfer into the higher temperature compartment 10, through the rear wall 2. Also the second evaporator section 22 is arranged at a gap-forming distance from the rear wall and provided with a flanged baffle element 35 on its side facing away from the gap 36 and rear wall 2.

Above, an exemplifying embodiment of the invention has been described. The invention may however be modified within the scope of the appending claims. Instead of being arranged at a distance from the dividing wall, the first evaporator section, or a part thereof, may be arranged on the surface of freezer compartment side of the partition wall. The whole or a part of the first evaporator section may also be arranged inside the partition wall. In such a case, a part of the transverse section of the first evaporator tube section may be arranged to project from the partition wall into the freezer compartment. Alternatively, the first evaporator tube section may be entirely arranged inside the partition wall, whereby heat transferring means, such as flanges, preferably are arranged in thermal contact with the first evaporator tube section and projecting into the freezer compartment.

Also the arrangement of the second evaporator section may be varied in a number of different ways. For instance, instead of being arranged in parallel with the rear wall, it may be arranged in parallel with the partition wall, at that side of the partition wall, which faces the higher temperature refrigerator compartment. In both cages, also the second evaporator section may be arranged at a distance from the partition wall, on the partition wall surface or inside the partition wall, as described for the first evaporator section above.

Both the first and second evaporator sections may have other tube configurations than the ones described above. They may for instance be formed by fewer or more inter-connected straight tube portions or they may be formed by tube sections which are curved along their whole lengths.

In the above-illustrated embodiment, the partition wall hermetically seals off the freezer and the higher temperature compartments from each other. Small deviations from this principle may be allowed, as long as no significant heat transfer is effected between the two compartments.

What is claimed is:

1. Absorption refrigerator (1) comprising:

a cabinet having outer walls (2,3,4,5,6) and at least one door (7,8), said cabinet enclosing a low temperature storage compartment (9) and a higher temperature storage compartment (10), said compartments being essentially sealed from each other and separated by a partition wall (11), said partition wall being arranged inside the cabinet and generally perpendicular to a first wall (2) of said outer walls, and an absorption refrigerating system including an evaporator tube (20) comprising a first evaporator tube section (21) for cooling the low temperature compartment and a second evaporator tube section (22) for cooling the higher temperature compartment, said second evaporator tube section being arranged downstream of said first evaporator tube section with respect to a direction of flow of a coolant, wherein a substantial portion of said first evaporator tube section (21) is arranged generally in parallel with said partition wall (11), and wherein said substantial portion of the first tube section (21) includes two non-coaxial tube portions (21*a*) the axes of said tube portions together defining a general extension plane of said substantial portion of the first evaporator section said general extension plane being arranged generally in parallel with said partition wall (11).

2. Refrigerator according to claim 1, wherein the general extension plane of the substantial portion of the first evaporator tube section (21) is arranged generally parallel to and closer to the partition wall (11) than to each of said outer walls.

3. Refrigerator according to claim 1 or 2, wherein said first wall (2) is a rear wall being arranged opposite to the door (7,8) and said partition wall (11) is extending in parallel with a generally vertical plane between the back wall (2) and the door (7,8).

4. Refrigerator according to claim 1 or 2 wherein said substantial portion of said first evaporator tube section (21) is arranged adjacent a surface said partition wall (11), said surface of said partition wall facing the low temperature storage compartment (9).

5. Refrigerator according to claim 1 or 2, wherein a gap (33) is formed between said substantial portion of said first evaporator tube section (21) and said partition wall (11).

6. Refrigerator according to claim 1 or 2, wherein said substantial portion of said first evaporator tube section (21) is arranged at least partly within said partition wall (11).

7. Refrigerator according to claim 1 or 2, wherein said first evaporator tube section (21) is provided with heat transferring flanges (34).

8. Refrigerator according to claim 1 or 2, wherein said second evaporator tube section (22) is arranged generally in parallel with said first wall (2).

9. Refrigerator according to claim 1 or 2, wherein said second evaporator section (22) is arranged generally in parallel with the partition wall (11), at an opposite side of the partition wall from the first evaporator tube section (21).

* * * * *